US005443214A

United States Patent [19]

Lesar

[11] Patent Number: 5,443,214

[45] Date of Patent: Aug. 22, 1995

[54] HARD MATERIAL COLLECTOR ASSEMBLY FOR A GRINDER

[75] Inventor: Nick J. Lesar, Palmyra, Wis.

[73] Assignee: Weiler and Company, Inc., Whitewater, Wis.

[21] Appl. No.: 133,900

[22] Filed: Oct. 12, 1993

Related U.S. Application Data

[63] Continuation-in-part of Ser. No. 654,942, Feb. 13, 1991, Pat. No. 5,251,829.

[51] Int. Cl.[6] ..... B02C 18/30; B02C 18/36

[52] U.S. Cl. ..... 241/82.2; 241/82.6; 241/82.3; 241/82.4; 241/260.1; 241/285.2; 241/292.1; 241/294

[58] Field of Search ..... 241/82.1–82.7, 241/260.1, 292.1, 294, 285.1, 285.2

[56] References Cited

U.S. PATENT DOCUMENTS

| | | | |
|---|---|---|---|
| 366,706 | 7/1887 | Williams, Jr. | 241/82.6 |
| 472,973 | 4/1892 | Arnaud | 241/82.6 |
| 737,783 | 9/1903 | Schyia . | |
| 1,514,271 | 11/1924 | Tilden . | |
| 1,619,632 | 3/1927 | Perrault et al. | 241/82.6 X |
| 2,166,197 | 7/1939 | Schaub . | |
| 2,445,037 | 7/1948 | Richard | 241/82.6 |
| 2,624,384 | 1/1953 | Ward | 241/82.5 |
| 2,640,033 | 5/1953 | Marshall . | |
| 2,694,426 | 11/1954 | Ward | 241/82.5 X |
| 2,924,257 | 2/1960 | Reid, Sr. | 241/82.5 |
| 3,340,917 | 9/1967 | Vedvik . | |
| 3,739,994 | 6/1973 | McFarland . | |
| 3,762,658 | 10/1973 | Barnes . | |
| 3,847,360 | 11/1974 | Seydelmann . | |
| 3,917,178 | 11/1975 | Barnes . | |
| 3,934,827 | 1/1976 | Seydelmann . | |
| 3,971,514 | 7/1976 | Martinelli et al. | 241/82.5 X |
| 4,004,742 | 1/1977 | Hess . | |
| 4,014,075 | 3/1977 | van Bergen . | |
| 4,018,390 | 4/1977 | Funakubo | 241/82.5 |

(List continued on next page.)

FOREIGN PATENT DOCUMENTS

| | | |
|---|---|---|
| 2242151 | 3/1975 | France . |
| 197056 | 5/1907 | Germany . |
| 587177 | 4/1932 | Germany . |
| 2809609 | 9/1979 | Germany . |
| 3820316 | 12/1989 | Germany . |
| 428436 | 12/1947 | Italy . |
| 726754 | 3/1955 | United Kingdom . |
| 1250325 | 8/1986 | U.S.S.R. . |
| 3715322 | 8/1986 | U.S.S.R. . |
| 1386299 | 4/1988 | U.S.S.R. . |

*Primary Examiner*—Frances Han
*Attorney, Agent, or Firm*—Andrus, Sceales, Starke & Sawall

[57] ABSTRACT

A meat grinder including an orifice plate mounted to a housing outlet. The orifice plate having a series of outer grinding passages through which soft material passes and a series of spaced hard material collection passages toward the center of the orifice plate. A ramped entryway is formed in the orifice plate adjacent each collection passage and defines a structure for facilitating the routing of hard material into the collection passages. A bushing is mounted within the opening formed in the orifice plate for receiving a centering shaft which is interconnected with a feed screw extending through the housing. A key-and-keyway structure is interposed between the bushing and the orifice plate. A retaining ring is threadedly engaged with the bushing for maintaining the bushing and an adaptor in position relative to the orifice plate. A discharge auger is mounted to the end of the centering shaft and extends through the collection cavity for rotation along with the feed screw and the centering shaft. The housing has ribs or flutes to ensure axial movement of the hard material upon rotation of the discharge auger. A discharge tube is removably connected to the collection housing and a series of nozzle inserts are engageable with the discharge tube for controlling the flow rate of the hard material therethrough by providing differently sized passages for restricting the discharge of the hard material from the collection housing.

10 Claims, 8 Drawing Sheets

U.S. PATENT DOCUMENTS 4,108,387 8/1978 Weiler ..... 241/82.5
4,141,113 2/1979 Van Bergen .
4,153,208 5/1979 Vomhof et al. .
4,189,104 2/1980 dos Santos .
4,202,502 5/1980 Laska .
4,358,061 11/1982 Richter .
4,408,725 10/1983 Wenger et al. ..... 241/260.1
4,422,582 12/1983 Roeger et al. .
4,536,920 8/1985 Amersfoort .
4,600,160 7/1986 Mengel et al. ..... 241/282.2
4,613,085 9/1986 Simonsen .
4,638,954 1/1987 Poss ..... 241/260.1 X
4,699,325 10/1987 Hess .
4,700,899 10/1987 Powers et al. .
4,795,104 1/1989 Rudibaugh .
4,928,892 5/1990 Huebner et al. .
5,041,055 8/1991 Roth .
5,251,829 10/1993 Lesar ..... 241/30
5,289,979 3/1994 Lesar ..... 241/82.6

HARD MATERIAL COLLECTOR ASSEMBLY FOR A GRINDER

CROSS REFERENCE TO RELATED APPLICATION

This application is a continuation-in-part of application Ser. No. 07/654,942 filed Feb. 13, 1991, now U.S. Pat. 5,251,829 issued Oct. 12, 1993.

BACKGROUND AND SUMMARY

This invention relates to a grinder such as for use in grinding materials such as meat, and more particularly to features for use with a grinder which facilitate removal of hard material such as bone, sinew or gristle or other material so that such materials are not ground along with the meat.

In high volume production of ground meat, it is common for the meat being ground to contain hard materials such as bone, sinew, gristle or the like. It is desirable to remove such material prior to or during grinding of the meat, to ensure that the hard material is not ground along with the meat.

A meat grinder typically includes an orifice plate located at the open end of a tubular housing, and a rotating knife assembly provides a series of knives disposed against a surface of the orifice plate. The knives are mounted to a knife holder, which typically comprises a series of radial arms extending outwardly from a central hub. To remove hard material during grinding, it has been known to provide a series of collection orifices toward-the central portion of the orifice plate. With a system of this type, rotation of the knife assembly moves the hard material around the orifice plate, with the hard material eventually making its way toward the center of the orifice plate, where it is received into one of the collection orifices.

A system such as that summarized above generally works satisfactorily to remove hard material from meat during grinding of the meat. However, it has been found that with a lower grade of meat being ground, which contains a greater amount of hard material than higher grade meat, it is nearly impossible for such a system to remove substantially all of the hard material during grinding of the meat.

Accordingly, the present invention has as its object to provide a hard material collection system for use with a meat grinder, which enhances the ability of the grinder to collect hard material during grinding of the meat. It is a further object of the invention to provide a hard material collection system which is used in connection with a conventional grinding system, in which a feed screw advances the meat through a housing toward an orifice plate, and in which a rotating knife assembly is disposed toward the end of the feed screw against the inner surface of the orifice plate. It is further an object of the invention to provide a hard material collection system which is relatively simple in design and in installation, yet which provides a greatly increased ability to collect hard material prior to passing of the hard material through the meat grinding orifices of the orifice plate.

In accordance with one aspect of the invention, a series of spaced collection openings or passages are located toward the center of the orifice plate for collecting hard material such as bone, gristle, sinew or the like. Each collection opening includes a ramped entryway opening onto the surface of the orifice plate facing the knife assembly. The collection openings are relatively large openings, and are located inwardly of relatively small outer openings through which the soft material passes. The ramped entryway to each collection opening extends outwardly toward the outer openings. The collection openings are preferably oval or kidney shaped in plan, and the ramped entryways extend outwardly along one of the long sides of each collection opening. The ramped entryways assist in feeding hard material into the collection openings, and also cooperate with the ends of the collection openings to define shearing edges. When a piece of hard material which is larger than the collection opening is directed into one of the collection openings by the ramped entryway associated therewith, the hard material lodges in the collection opening. Movement of the knife assembly over the collection opening shears off the hard material against the shearing edge defined by the ramped entryway in combination with the end of the collection opening. The portion of the piece of the hard material within the collection opening thereafter passes through the collection opening, and the portion which is sheared off is directed into another collection opening for repeated shearing until it is of a size small enough to pass through a collection opening. The longitudinal axes of the collection passages may either be tangential or radial relative to the center of the orifice plate. When the collection passages are oriented radially, the ramped entryways extend perpendicularly relative to the longitudinal axes of the slots, with the ramped entryways having a width approximately equalling the length of the slots. The ramped entryways are pitched away from the center of the orifice plate, such that the area of greatest depth of each entryway is located at its outermost extent. The edges defined by each ramped entryway and its associated slot function to guide chunks of hard material into the slot while simultaneously shearing the hard material as the knife assembly passes over the entryway and slot.

In accordance with a further aspect of the invention, the hard material is discharged from the collection passages into a hard material collection cavity defined by a collection cup or cone, which further defines a discharge passage for receiving the hard material from the collection cavity. A hard material discharge auger is connected to the outer end of a centering shaft interconnected with the grinder feed screw and rotatable therewith, and the discharge auger extends through the collection cavity into the discharge passage. Rotation of the hard material discharge auger, which is imparted to the hard material discharge auger from the centering shaft, functions to move the collected hard material downstream from the collection cavity to the discharge passage. The hard material is discharged from the discharge passage into a passage defined by a conduit for ultimate discharge into a collection receptacle. The internal walls of the cup or cone defining the collection cavity may be provided with one or more ribs to prevent the collected hard material from simply spinning within the collection cavity, and to ensure that such material continues to move axially downstream toward the discharge passage. Alternatively, flutes may be formed in the discharge passage itself to ensure axial movement of the collected hard material.

In accordance with another aspect of the invention, the rotating knife assembly includes a central hub and a plurality of knife holding arms extending outwardly from the hub, with a knife mounted to each knife holding arm. The arms are arranged so as to be non-radial relative to the hub, thereby providing non-radial mounting of the knives. This arrangement facilitates movement of the hard material inwardly toward the hub during rotation of the knife assembly. In a preferred embodiment, the hub is provided with a collection pocket forwardly of each knife holding arm for receiving hard material moved inwardly toward the hub during rotation of the knife assembly. The collection pockets on the hub are preferably located in alignment with the collection openings in the orifice plate. The collection openings preferably include ramped entryways as described above for facilitating entry of hard material into the collection openings.. Each collection pocket preferably includes an outwardly facing ramped area provided on the hub forwardly of each knife holding arm. In a preferred arrangement, each arm includes a base connected to the hub and an outer end spaced outwardly from the base. Each arm is arranged such that its longitudinal axis is non-parallel to a line extending through its base and through the center of the hub. In this manner, the longitudinal axis of each arm is tangential to a circle concentric with the center of the hub. In a particularly preferred arrangement, the longitudinal axis of each arm is tangential to a common circle concentric with the center of the hub. In one embodiment, the arms are arranged such that the longitudinal axis of each arm is substantially perpendicular to the longitudinal axes of its adjacent arms.

In accordance with yet another aspect of the invention, the knife holder includes a hub and a plurality of knife holding arms extending outwardly therefrom, with a substantially central passage formed in the hub and adapted to receive a centering shaft therethrough. Each knife holding arm has a forwardly opening knife mounting slot formed therein, with each slot opening into the central passage in the hub. A knife mounting pin extends transversely through each knife mounting slot, and is located toward the outer end of each knife holding arm. Each knife is provided with an outwardly opening pin-receiving slot adapted to receive the knife mounting pin therein, wherein the centering shaft and the knife mounting pins cooperate to maintain the knives in position within the slots. This mounting structure acts to positively retain the knives in the knife holder once the centering shaft is inserted through the central passage formed in the hub.

In accordance with a further aspect of the invention, a recovery grinding arrangement is provided downstream of the orifice plate. The recovery grinding arrangement recovers and grinds any soft material which may have passed through the collection openings along with the hard material. The recovery grinding arrangement includes a housing having a rotating recovery knife assembly located within its interior. Material passing through the collection openings is routed to the interior of the housing. In one embodiment, a secondary orifice plate is mounted to the end of the housing, and the soft material is forced by the rotating knife assembly through orifices formed therein. The recovered soft material is then mixed with the ground soft material discharged from the primary orifice plate. In another embodiment, a series of orifices are formed in an upper side wall of the housing. The rotating knife assembly forces the recovered soft material upwardly through the orifices, where it mixes with the soft material discharged from the primary orifice plate. In both embodiments, a discharge tube is connected at the outer end of the housing, and includes an internal passage in communication with the interior of the housing. The hard material is routed by the rotating knife assembly to the internal passage of the discharge tube. A secondary auger is connected to the rotating knife assembly, and is disposed within the internal passage of the discharge tube for passing the hard material therethrough.

In accordance with yet another aspect of the invention, a bushing is mounted within an opening formed in the central portion of the orifice plate for receiving the centering shaft extending from the grinder feed screw. Mating structure, such as a key-and-keyway arrangement, is interposed between the bushing and the orifice plate for maintaining the bushing in a fixed rotational position relative to the orifice plate. The bushing includes a lip which engages the inner surface of the orifice plate, and the opposite end of the bushing includes a set of threads extending past the outer surface of the orifice plate. The bushing extends through a collection cup adaptor which engages the outer surface of the orifice plate, and a threaded ring is engaged with the threads of the bushing. This functions to securely mount the bushing to the orifice plate without the use of threads interposed directly between the bushing and the orifice plate, which have been found to loosen during use, and also provides a highly satisfactory system for mounting the collection cup in position at the downstream surface of the orifice plate. Slots are formed in the collection cup adaptor, and are adapted to align with the hard material collection passages formed in the orifice plate for allowing hard material to pass into the collection cavity. The key-and-keyway arrangement is also interposed between the adaptor and the bushing in order to ensure alignment between the collection passages in the orifice plate and the slots formed in the collection cup adaptor.

In accordance with a still further aspect of the invention, the discharge conduit downstream of the discharge passage may be adapted to receive one of a set of flow controlling nozzle inserts, in order to minimize the discharge of usable soft material into the collection cavity during grinding of the material. Each insert in the set defines a differently sized internal passage, and the inserts are adapted to be removed and replaced according to the conditions of the material being ground and the desired optimum flow rate of the hard material discharge. This controls the back pressure in the collection cavity and in the collection passages, for controlling the quantity of material allowed to pass through the collection passages.

In a particularly preferred embodiment of the invention, the various aspects and features as summarized above may be combined into a single structure for facilitating advancing of hard material toward the center of the orifice plate during grinding and passage of the hard material into the collection openings or passages formed in the orifice plate, and for recovering soft material which may pass through the collection openings along with the hard material.

Various other features, advantages and objects of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figures 1, 3:
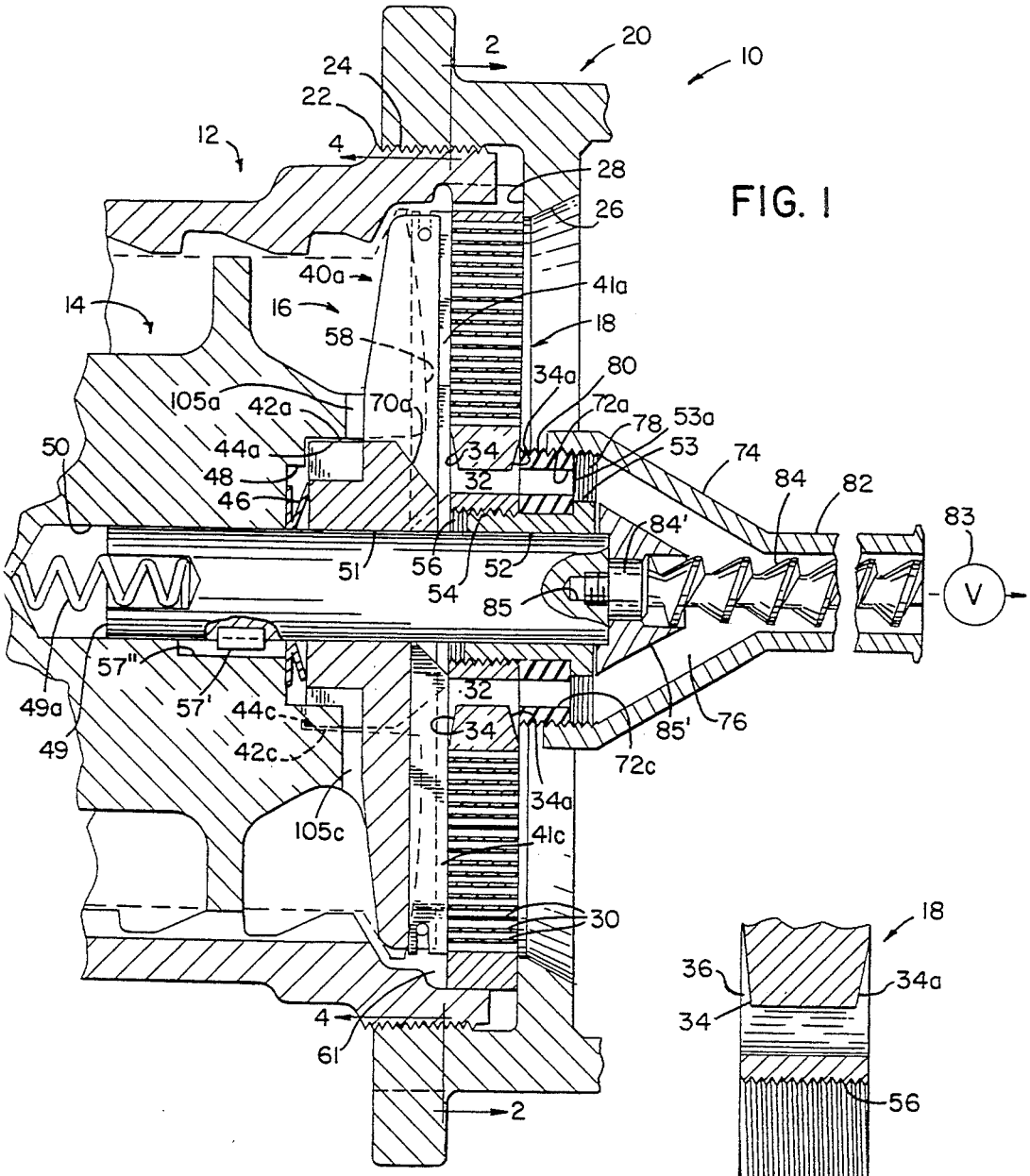
FIG. 1 is a partial cross-sectional view through the grinding head of a meat grinding machine, showing the features of the invention incorporated therein.
FIG. 3 is an enlarged partial sectional view showing the central portion of the orifice plate, with the collection openings extending therethrough.

FIG. 1 illustrates the grinding head 10 of a grinder for use in grinding material such as meat, which includes a tubular housing 12 within which a feed screw 14 is rotatably mounted. Housing 12 and feed screw 14 are generally constructed as is known in the art so that, upon rotation of feed screw 14 within housing 12, meat or the like is advanced within the interior of housing 12 toward grinding head 10.

A knife assembly, shown generally at 16, is mounted at the end of the feed screw 14. Knife assembly 16 is disposed against the inner surface of an orifice plate, generally shown at 18, which is secured in the open end of housing 12 by a mounting ring, shown generally at 20. In accordance with known construction, the end of housing 12 is provided with a series of external threads 22, and mounting ring 20 includes a series of internal threads 24, adapted to engage external threads 22 on housing 12. Mounting ring 20 further includes an opening 26 defining an inner lip 28, which is adapted to engage the outer peripheral portion of orifice plate 18 to maintain orifice plate 18 in position within the open end of housing 12.

Figure 2:
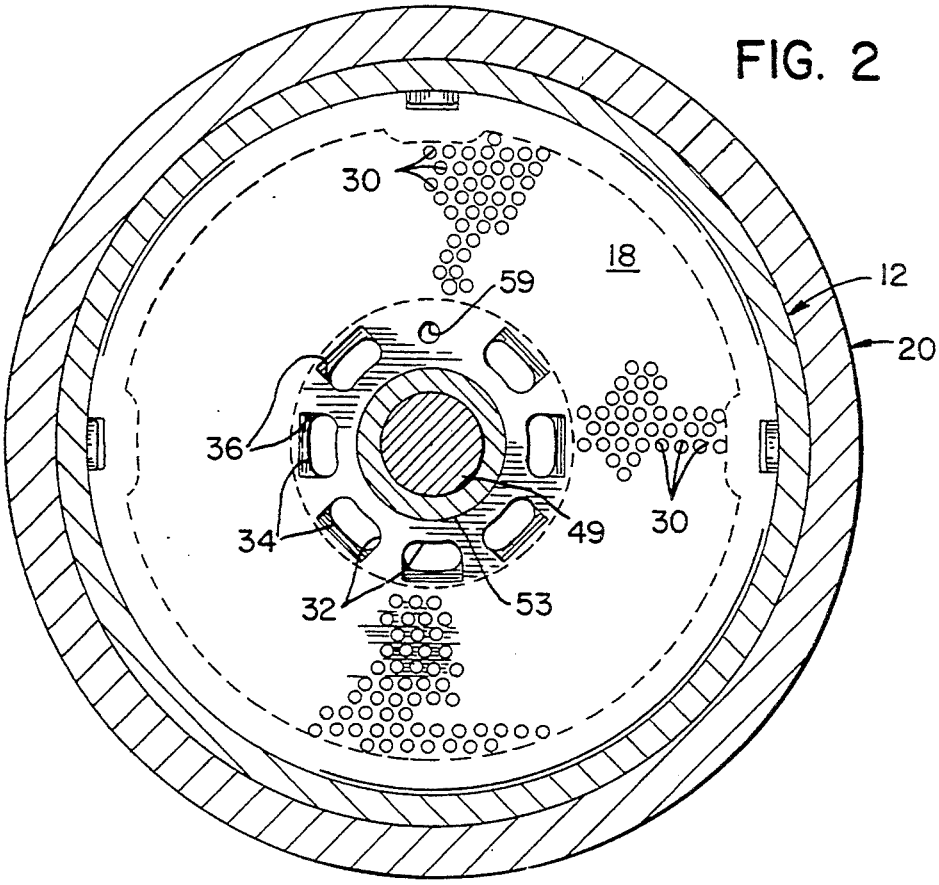
FIG. 2 is a sectional view taken generally along line 2—2 of FIG. 1.

Referring to FIGS. 1 and 2, orifice plate 18 is provided with a large number of relatively small grinding openings therethrough, such as shown at 30. The size of outer openings 30 varies according to the type of meat being ground. Generally, however, grinding openings 30 range from 3/32 inch to ½ inch in diameter. In accordance with known grinding principles, meat within the interior of housing 12 is forced toward orifice plate 18 by rotation of feed screw 14 and through openings 30, with rotating knife assembly 16 acting to sever the meat against the inner surface of orifice plate 18 prior to the meat passing through openings 30 in orifice plate 18.

As is also shown in FIGS. 1 and 2, a series of relatively large inner collection openings or passages 32 are formed in orifice plate 18 inwardly of the outer grinding openings 30. Collection openings 32 are located at a common radius from the center of orifice plate 18, and are equally radially spaced from each other. Collection openings 32 are generally oval or slightly kidney-shaped. Illustratively, collection openings 32 are approximately one inch long and three-eighths of an inch wide. As will be explained, collection openings 32 act to collect bone, gristle, sinew or other hard material prior to its passing through grinding openings 30 in orifice plate 18 during operation of grinding head 10.

Each of collection openings 32 is provided with a ramped entryway 34 opening onto the inner surface of orifice plate 18. Ramped entryways 34 are disposed at an angle of approximately 8 degrees to the surface of orifice plate 18, and extend outwardly from collection openings 32 in a direction toward the outer grinding openings 30. In a preferred embodiment, both the inner and outer surfaces of orifice plate 18 are provided with ramped entryways 34 leading into collection orifices 32. This arrangement accommodates mounting of orifice plate 18 at the end of housing 12 such that either of its surfaces can be employed as the inner cutting surface against knife assembly 16. In FIG. 1, the ramped entryways formed in the outer surface of orifice plate 18 are shown at 34*a*.

The end walls formed by each of the ramped entryways 34 provide shearing surfaces such as shown at 36, the purpose of which will later be explained.

Figure 4:
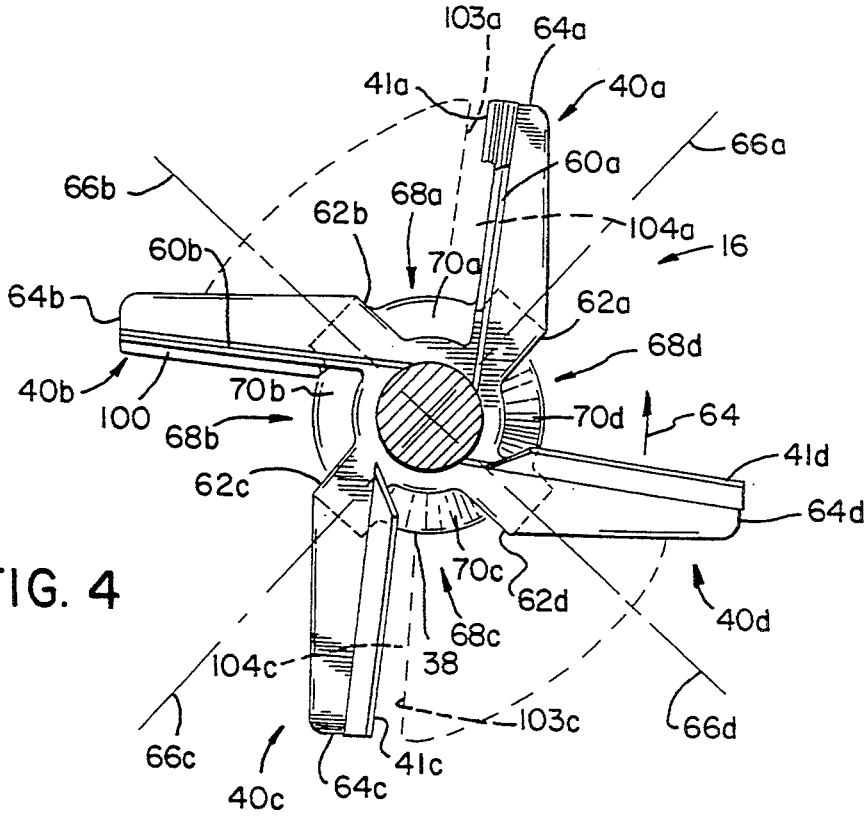
FIG. 4 is an end elevation view showing the knife holder assembly of the invention, reference being made to line 4—4 of FIG. 1.
Figure 5:
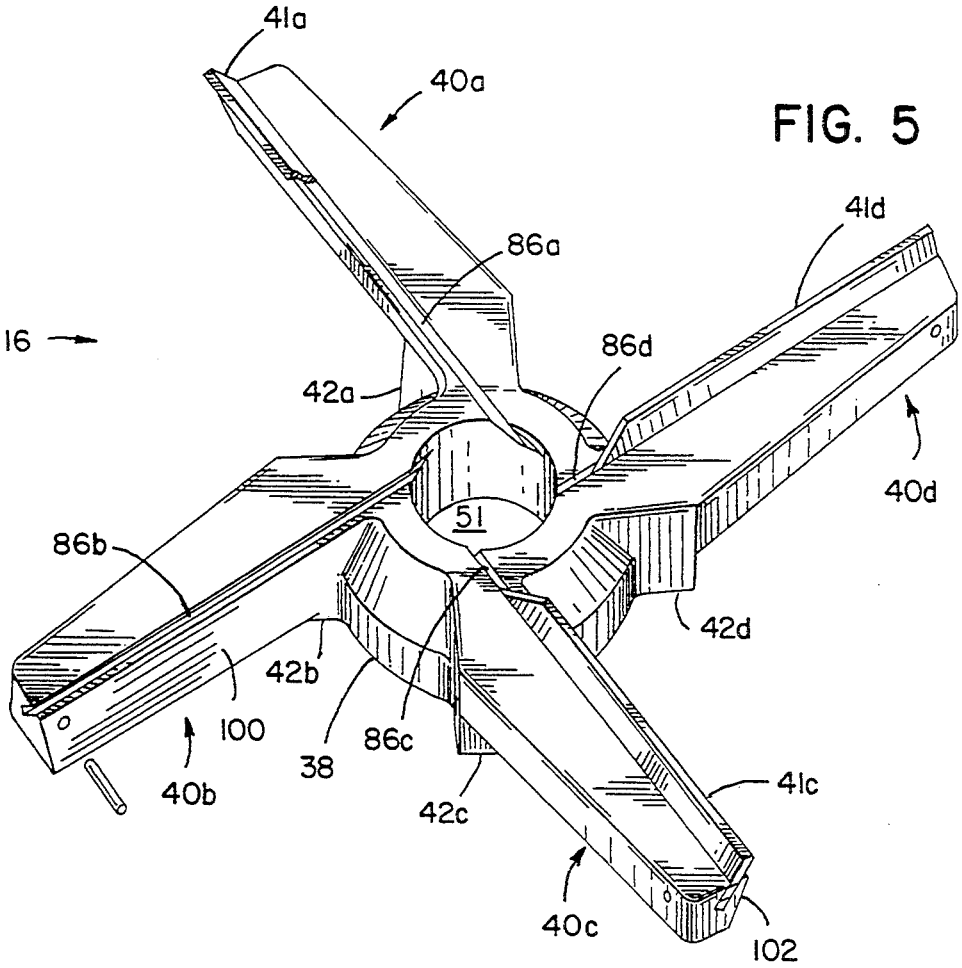
FIG. 5 is an isometric view of the knife holder assembly of FIG. 4.

Referring to FIGS. 1,4, and 5, rotating knife assembly 16 comprises a knife holder consisting of a central hub portion 38 and a series of knife holding arms 40*a*, 40*b*, 40*c* and 40*d* extending outwardly therefrom. Knives 41*a*, 41*b*, 41*c* and 41*d* are mounted in arms 40*a*–40*d*, respectively. A series of drive lugs, shown at 42*a*, 42*b*, 42*c* and 42*d*, are formed integrally with hub portion 38 and are in alignment with the inner portion of each of arms 40*a*–40*d*, respectively. Referring to FIG. 1, lugs 42*a*–42*d* are adapted for placement in mating recesses, such as shown at 44*a* and 44*c*, formed in the end of feed screw 14. Engagement of drive lugs 42*a*–42*d* with the walls of the mating recesses, such as shown at 44*a*, 44*c*, causes rotation knife assembly 16 in response to rotation of feed screw 14.

A belleville-type spring washer assembly, such as shown at 46, is placed within an annular inner recess 48 formed in the end of feed screw 14 which extends inwardly from the mating recesses, such as 44*a*, 44*c*, also formed in the end of feed screw 14. Spring washer 46 bears between the ends of drive lugs 42*a*–42*d* and the inner end wall of annular recess 48 to bias knife assembly 16 against the inner surface of orifice plate 18.

A centering shaft 49 has its inner end located within a central bore 50 formed in the end of feed screw 14, and its outer end extending through a central passage 51 formed in hub portion 38 of knife assembly 16. A spring 49*a* is located in a bore formed in the inner end of shaft 49, and bears against the inner end of bore 50. The outermost end of centering shaft 49 is received within a central passage 52 provided in a bushing 53. Bushing 53 acts to maintain an adaptor 53*a* in position against the outer surface of orifice plate 18, and includes external threads 54 which engage internal threads 56 formed in a central opening 57 (FIG. 3) formed in orifice plate 18. With this arrangement, bushing 53 and orifice plate 18 cooperate to rotatably support the end of feed screw 14 through centering shaft 49. Centering shaft 49 is keyed to feed screw 14 by means of a key 57' mounted to shaft 49 and engaged within a slot 57'' associated with bore 50. In this manner, shaft 49 rotates in response to rotation of feed screw 49.

Adaptor plate 53*a* is pinned to orifice plate 18 so as to be non-rotatable relative to orifice plate 18. As shown in FIG. 2, orifice plate 18 is provided with a pin-receiving hole 59, and adaptor plate 53*a* likewise is provided with a facing pin-receiving hole (not shown). A pin, or dowel, is placed within the facing pin-receiving holes in orifice plate 18 and adaptor plate 53*a* to fix adaptor plate 53*a* relative to orifice plate 18.

The mounting of knife assembly 16 to the end of feed screw 14 as shown and described provides adjustability of the clearance between the end of the tapered feed screw pressure flighting, shown at 58, and the inner surface of orifice plate 18 while maintaining the knives of knife assembly 16, such as shown at 41*a* and 41*c* in FIG. 1, against the inner surface of orifice plate 18. To increase the clearance between pressure flighting end 58 and the inner surface of plate 18, mounting ring 20 is turned on housing threads 22 so as to move ring 20 rightwardly. While this takes place, spring washer assembly 46 expands to urge knife assembly 16 rightwardly so as to maintain the knives against the inner surface of plate 18, and thereby maintaining the outer peripheral portion of plate 18 against lip 28 of mounting ring 20. If necessary, additional spring washers can be employed.

To decrease the clearance between pressure flighting end 58 and the inner surface of plate 18, mounting ring 20 is turned on housing threads 22 so as to move ring 20 leftwardly. This action forces spring assembly 46 to compress while maintaining the knives against the inner surface of orifice plate 18.

An annular space 61 (FIG. 1) is located outwardly of the ends of knife arms 40*a*–40*d*. Space 61 allows material to pass to a succeeding knife arm during rotation of knife assembly 16.

Referring to FIG. 4, the arrangement of knife holding arms 40*a*–40*d* relative to hub portion 38 is most clearly illustrated. As shown, arms 40*a*–40*d* are arranged so as to be non-radial relative to hub 38. More particularly, arms 40*a*–40*d* are positioned such that the longitudinal axis of each of arms 40*a*–40*d* *is* perpendicular to the longitudinal axis of its adjacent arms. In addition, the knives, such as shown at 41*a*, 41*c* and 41*d* as mounted to arms 40*a*, 40*c* and 40*d*, respectively, are also perpendicular to each other.

Arms 40*a*–40*d* each include a base portion such as shown at 62*a*–62*d*, respectively, which is mounted to hub portion 38. Arms 40*a*–40*d* further include outer end portions 64*a*–64*d*, respectively, spaced outwardly from base portions 62*a*–62*d*, respectively.

Knife assembly 16 is adapted for rotation in the direction of an arrow 64, when mounted to the end of feed screw 14.

Referring to arm 40*a* (FIG. 4), the orientation of arm 40*a* relative to a line 66*a* extending between the center of knife assembly 16 and the centroid of base portion 62*a* of arm 40*a* is such that arm 40*a* is oriented in the direction of arrow 64 away from line 66*a*. Each of arms 40*b*–40*d* is similarly oriented relative to lines 66*b*–66*d*, which extend through the center of knife assembly 16 and the centroid of the respective base portions 62*b*–62*d*. With this arrangement, the longitudinal axes of arms 40*a*–40*d* are tangential to a common circle concentric with the center of knife assembly 16.

With the forwardly disposed non-radial arrangement of arms 40*a*–40*d*, material located against the inner surface of orifice plate 18 and engaged by knife arms 40*a*–40*d* is generally swept inwardly toward the center of knife assembly 16 when it is rotated during operation of grinding head 10. A portion of such material may be swept outwardly upon rotation of knife assembly 16. Soft tissue is forced through grinding openings 30 before it reaches the central portion of plate 18. Hard material such as bone, sinew, gristle or the like, which does not readily pass through grinding openings 30, rides on plate 18 over openings 30 and is directed inwardly toward hub portion 38 of knife assembly 16 and the central area of plate 18. Upon continued rotation of knife assembly 16, the hard material is directed to ramped entryways 34 associated with collection openings 32, and is collected in openings 32. With a large piece of hard material which cannot pass into collection openings 32, the piece is lodged within entryway 34 into a collection opening 32 and is forced by knife assembly 16 against shearing surface 36 defined by the end of ramped entryway 34 in combination with the end area of collection opening 32. One of the knives (41*a*–41*d*) engages the piece of hard material, and cooperates with shearing surface 36 to cut the piece of material lodged within entryway 34. The portion of material within entryway 34 is then passed into collection opening 32, while the remainder of the piece of material is directed by the knife assembly into another of entryways 34. The above-described action repeats until the piece of material is reduced to a size small enough to pass in its entirety through one of collection openings 32.

It should be appreciated that knife arms 40*a*–40*d* may alternatively be arranged radially relative to hub portion 38, or arranged non-radially with arms 40*a*–40*d* being angled rearwardly. The specific arrangement of arms 40*a*–40*d* will be determined largely by the type and grade of material being ground. In any case, it has been found that hard material displays a tendency to migrate toward the center upon rotation of the knife assembly. This tendency simply increases when the knife arms are angled forwardly.

Referring to FIGS. 1, 4 and 5, knife assembly 16 includes pockets 68*a*, 68*b*, 68*c* and 68*d* formed in hub portion 38. Pockets 68*a*–68*d* are disposed forward of the forward edges of knife arms 40*a*–40*d*, respectively. Each of pockets 68*a*–68*d* is defined in part by an outwardly facing ramped surface 70*a*–70*d*, respectively. Referring to FIG. 1, the ramped surfaces, such as 70*a*, are located on hub portion 38 so as to intersect a longitudinal axis through each of collection openings 32. The ramped surfaces, such as 70*a*, cooperate with ramped entryways 34 into collection openings 32, to define a passage for directing hard material into ramped entryways 34 and collection openings 32. Pockets 68*a*–68*d* provide a low pressure toward the center of knife assembly 16, for facilitating passage of material inwardly toward the central portion of orifice plate 18 during rotation of knife assembly 16. In this manner, hard material which does not readily pass through grinding openings 30 is directed into ramped entryways 34 and collection openings 32.

Adaptor plate 53*a* is provided with a series of spaced passages therethrough, shown in FIG. 1 at 72*a* and 72*c*. The passages (72*a*, 72*c*) in adaptor plate 53*a* are placed into alignment with collection openings 32 in orifice plate 18, when adaptor plate 53*a* is pinned to plate 18 as described previously.

A collection cup 74 having a collection cavity 76 is mounted to adaptor plate 53*a* by internal threads 78 provided on collection cup 74 engaging external threads 80 formed on bushing 53. A discharge tube 82 extends from the outer end of cup 74, and includes an internal passage adapted to receive material from collection cavity 76. A valve 82 may be provided downstream of discharge tube 82 for controlling the pressure in tube 82 and the rate of discharge of hard material therefrom. Valve 83 is preferably adjustable so that an optimal pressure setting can be attained to ensure that substantially all hard material passes into collection openings 32 while a maximum amount of soft tissue passes through grinding openings 30 before being forced by knife assembly 16 into the central area of orifice plate 18. This pressure may also be controlled by adjusting the amount of engagement between collection cup internal threads 78 and adaptor plate threads 80, and thereby the amount of flow restriction provided by collection cavity 76.

A discharge auger 84 is mounted to the end of centering shaft 49 and is rotatable therewith in response to rotation of feed screw 14, for assisting in discharging the collected hard material from collection cavity 76 of cup 74 and into the internal passage of discharge tube 82. Discharge auger 84 is provided at its inner end with a non-circular hub 84', and a threaded stub shaft extends from hub 84' into engagement with internal threads provided in a bore 85 formed in the outer end of centering shaft 49. A frustoconical collar member 85' is mounted to the end of centering shaft 49 along with discharge auger 84, and is rotatable therewith by engagement of auger hub 84' with the walls of an internal passage formed in collar member 85' in which hub 84' is located. In this manner, collar member 85' is rotatable along with discharge auger 84 in response to rotation of feed screw 14.

The outer walls of collar member 85' are oriented substantially parallel to the inner walls of collection cup 74, so that a tapered annular passageway is formed in collection cavity 76 through which the collected hard material passes into the internal passage of discharge tube 82. Discharge auger 84 assists in moving the collected hard material into and through the internal passage of discharge tube 82, to reduce the back pressure within collection cavity 76 and to facilitate passage of collected hard material through collection openings 32 and the passages, such as 72*a*, 72*c*, formed in adaptor plate 53*a* and into collection cavity 76.

Reference is now made to FIGS. 1 and 5–7 for an explanation of the manner in which knives 41*a*–41*d* are mounted to knife arms 40*a*–40*d*, respectively. As shown in FIG. 5, arms 40*a*–40*d* are provided with knife mounting slots 86*a*–86*d*, respectively. Each of slots 86*a*–86*d* extends throughout the length of its respective knife arm, and opens into central passage 51 provided in hub portion 38 of knife assembly 16. Slots 86*a*–86*d* are slanted relative to the outer faces of knife arms 40*a*–40*d*, respectively, to provide a forward angled orientation of knives 41*a*–41*d* relative to the outer faces of knife arms 40*a*–40*d*, respectively.

Figure 7:
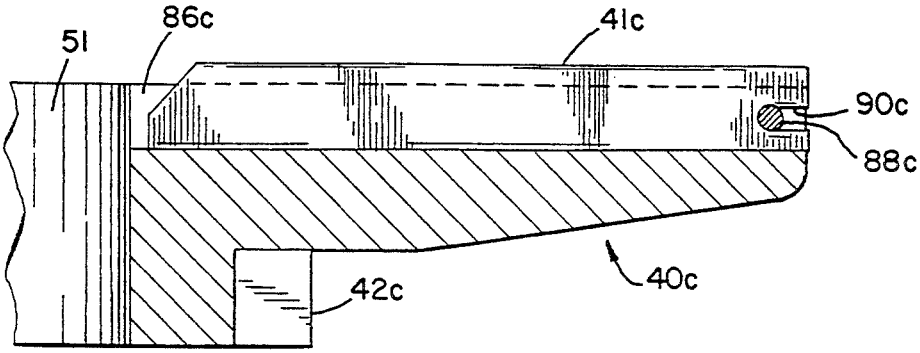
FIG. 7 is a view similar to FIG. 6, showing mounting of a knife in the knife holder assembly of the invention.

Referring to FIG. 7, knife arm 40*c* and knife 41*c* are illustrated. A knife mounting pin 88*c* is provided toward the outer end of knife arm 40*c*, extending transversely through knife mounting slot 86*c*. Knife mounting pin 88*c* is pressed-fit into a transverse opening formed in the outer end of knife arm 40*c*. Knife 41*c* includes an outwardly facing knife mounting slot 90*c* formed in its outer end. Knife 41*c* is mounted to knife arm 40*c* by first inserting the length of knife 41*c* into slot 86*c* so that the outer end of knife 41*c* clears knife mounting pin 88*c*. In this position, a portion of the inner end of knife 41*c* is disposed within passage 54 formed in hub portion 38. Knife 41*c* is then slid rightwardly within knife mounting slot 86*c*, so that pin-receiving slot 90*c* in its outer end receives knife mounting pin 88*c* and pin 88*c* engages the inner end of pin-receiving slot 90*c*. After centering shaft 49 is inserted through passage 51 formed in hub portion 38, leftward movement of knife 41*c* within knife mounting slot 86*c* results in the leftward end of knife 41*c* engaging centering shaft 49 before knife mounting pin 88*c* exits pin-receiving slot 90*c*. In this manner, knife 41*c* is positively retained within knife mounting slot 86*c* of knife arm 40*c*.

Knives 41*a*, 41*b* and 41*d* are retained in knife mounting slot 86*a*, 86*b* and 86*d*, respectively of knife arms 40*a*, 40*b* and 40*d* in a similar manner.

Figure 6:
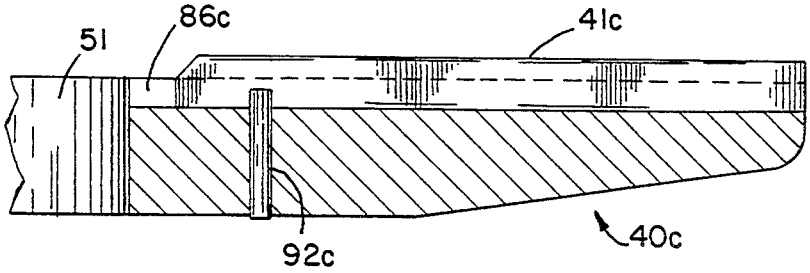
FIG. 6 PRIOR ART
FIG. 6 is a partial sectional view showing prior art mounting of knives in a prior art knife holder assembly.

FIG. 6 illustrates a prior art system of mounting a knife within a knife arm. Like reference characters will be used where possible to facilitate clarity. In the arrangement shown in FIG. 6, knife arm 40*c* again includes a knife mounting slot 86*c* which extends throughout the length of knife arm 40*c* between its outer end and inwardly opening into passage 51. A knife mounting pin 92*c* is press-fit into an opening formed in the rearward portion of knife arm 40*c*, with its forward edge extending into knife mounting slot 86*c*. Knife 41*c* is provided with a notch 94 which receives the end of pin 92*c*. With this arrangement, knife 41*c* is not positively retained within knife mounting slot 86*c*. Rather, pin 92*c* and notch 94 simply cooperate to fix to lateral position of knife 41*c* relative to knife arm 40*c*. With the knife mounting arrangement as illustrated in FIG. 7, providing positive retention of the knives within the knife mounting slots formed in the knife arms, changing of orifice plates is accomplished in a quicker and more efficient manner, in that the operator does not have to be concerned with making sure the knives do not fall out of the knife mounting slots formed in the knife arms. As long as centering shaft 49 remains in place in passage 51 formed in hub portion 38 of knife assembly 16, the knives are positively retained and cannot be removed from the knife mounting slots.

Referring to FIGS. 4 and 5, the forward face of knife arm 40*b* is provided with a forwardly extending ramped surface, shown at 100. While not visible in FIGS. 4 and 5, the forward face of knife arm 40*d* is similarly provided with a forwardly extending ramped surface. As shown in FIG. 5, the forward face of knife arm 40*c* is provided with a rearwardly extending ramped surface 102. Knife arm 40*a*, which is opposite knife arm 40*c*, is similarly provided with a rearwardly extending ramped surface.

When rotating knife assembly 16 is mounted to the end of feed screw 14, knife arms 40*a* and 40*c* are located adjacent the termination of the pressure flights, such as shown in phantom in FIG. 4 at 103*a* and 103*c*, at the end of feed screw 14. Accordingly, arms 40*b* and 40*d* are located at 90° to the pressure flight terminations 103*a*, 103*c*. With this arrangement, the rearwardly (or inwardly extending ramped surfaces on knife arms 40*a* and 40*d* act to relieve some of the pressure generated by the pressure flight terminations 103*a*, 103*c* during rotation of feed screw 14. The forwardly (or outwardly) extending ramped surfaces, such as surface 100 on the forward face of arm 40*b*, act to generate pressure forcing the material toward the inner surface of orifice plate 18 at arms 40*b*, 40*d* during rotation of feed screw 14. In this manner, the pressure forcing the material toward orifice plate 18 is more evenly distributed between arms 40*a*, 40*d*.

Gaps, such as shown at 104*a* and 104*c* in FIG. 4, are present between pressure flight terminations 103a, 103*c* and the forward faces of knife arms 40*a*, 40*c*, respectively. Gaps 104*a*, 104*c* lead to passages, such as shown at 105*a*, 105*c* in FIG. 1, formed between the inner surfaces of the knife arms and the end of feed screw 14. The gaps, such as 104*a* and 104*c*, and the passages, such as 105*a* and 105*c*, cooperate to allow hard material to pass rearwardly from one knife arm to the next during rotation of the knife assembly. This provides further insurance that hard material is not excessively forced against the inner surface of orifice plate 18 before it reaches collection openings 32.

Figure 8:
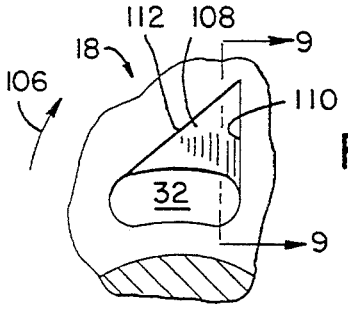
FIG. 8 is an enlarged partial elevation view showing an alternate embodiment for the ramped entryways associated with the collection openings formed in the orifice plate.
Figure 9:
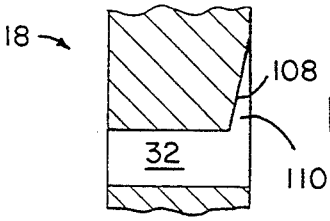
FIG. 9 is a partial sectional view taken generally along line 9—9 of FIG. 8.

FIGS. 8 and 9 illustrate an alternate arrangement for the ramped surfaces leading into collection openings 32 formed in orifice plate 18. In this arrangement, the knife assembly rotates in the direction of an arrow 106. The ramped surface leading into collection opening 32 is shown at 108. Ramped surface 108 extends outwardly toward the outer grinding orifices 30 formed in orifice plate 18, tapering upwardly and outwardly from collection opening 32. Ramped surface 108 terminates at its rightward end in a shearing edge 110, which is substantially triangular in shape. Ramped surface 108 intersects the inner surface of orifice plate 18 at a line shown at 112, which extends between the outer end of shearing edge 110 and the leftward end of collection opening 32. This arrangement acts to force the hard material downwardly on ramped surface 108 toward collection opening 32 and shearing edge 110, so that a maximum amount of area of shearing edge 110 is available for acting on the hard material along with the knives to shear the hard material off and to facilitate its passage into collection openings 32. Ramped surface 108 is substantially in the form of a right triangle defined between shearing edge 110, the outer wall of collection opening 32, and line of intersection 112.

Ramped surface 108 has a depth of approximately $\frac{1}{8}$ inch at the outer wall of collection opening 32, and is inclined relative to the inner surface of orifice plate 18 at an angle of approximately 8.5°.

With some types of material being ground, a situation sometimes arises in which a substantial amount of usable soft tissue passes through collection openings 32 along with the hard material. In such situations, it is desirable to recover the usable soft material in order to reduce the amount of wasted usable material. FIGS. 10–13 illustrate two arrangements for recovering usable material which passes through collection openings 32.

Figure 10:
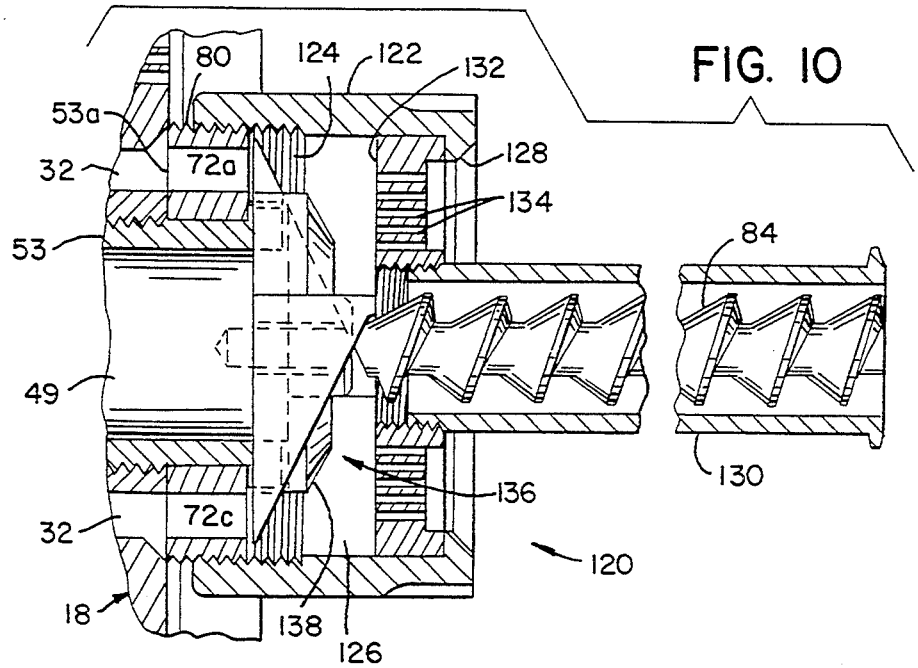
FIG. 10 is a partial sectional view showing one embodiment of a recovery grinder arrangement for grinding of soft material which passes through the collection openings formed in the orifice plate.

Referring to FIG. 10, a recovery grinding arrangement 120 generally includes a cylindrical housing member 122 having internal threads 124 for engaging external threads 80 provided on adaptor plate 53*a*. Housing 122 defines an internal collection cavity 126, and an opening 128 is provided at the outer end of housing member 122.

In the same manner as described previously with respect to FIG. 1, a discharge auger 84 is mounted to the end of centering pin 49 and is rotatable therewith in response to rotation of feed screw 14. Discharge auger 84 is located within a discharge passage formed in a discharge tube 130, which is threadedly engaged with a central passage formed in a secondary orifice plate, shown at 132. As with orifice plate 18, secondary orifice plate 132 is provided with a series of discharge orifices 134, which may be somewhat smaller in diameter than orifices 30 formed in primary orifice plate 18.

Secondary orifice plate 132 engages an inwardly extending lip which forms opening 128 in the outer end of housing 122.

Figure 11:
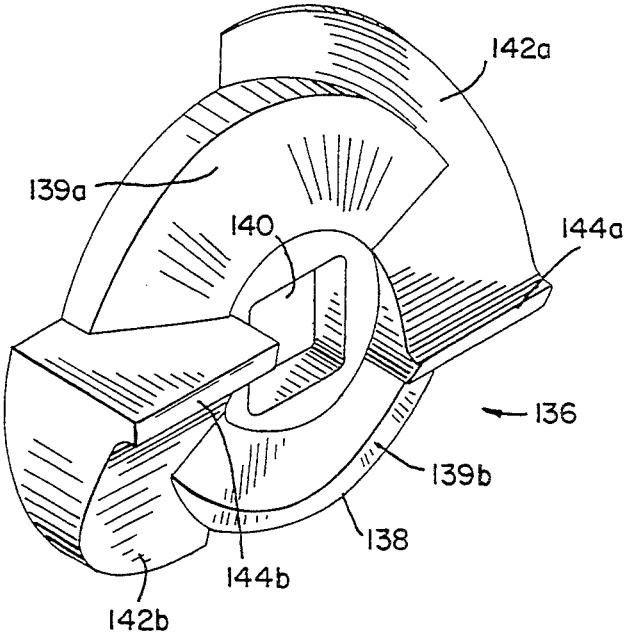
FIG. 11 is an isometric view showing the rotating recovery knife assembly provided in the recovery grinding arrangement of FIG. 10.

A recovery knife assembly 136, shown in FIGS. 10 and 11, is located between the end of centering shaft 49 and the inner surface of secondary orifice plate 132. Recovery knife assembly 136 generally comprises a disk-like body portion 138 having a square aperture 140 formed therein. The hub of discharge auger 84 is placed within aperture 140, so that recovery knife assembly 136 is rotatable in response to rotation of centering shaft 49 and feed screw 14. Body portion 138 includes a pair of beveled surfaces 139*a*, 139*b*.

Spring 49*a* (FIG. 1) urges recovery knife assembly 136 against the inner surface of secondary orifice plate 132.

Recovery knife assembly 136 further includes a pair of angled flights 142*a*, 142*b*, which terminate in a pair of knife tips 144*a*, 144*b*, respectively. Material passing through the passages, such as 72*a*, 72*c*, formed in adaptor plate 53*a*, is picked up by flights 142*a*, 142*b* and fed thereon toward knife tips 144*a*, 144*b* and toward the inner surface of secondary orifice plate 132. The hard material migrates along beveled surfaces 139*a*, 139*b* toward the center of recovery knife assembly 136 and into the inlet of the internal passage provided in discharge tube 130. The soft material migrates outwardly toward orifices 134 formed in orifice plate 132, and is forced therethrough by pressure generated by flights 142*a*, 142*b* upon rotation of recover knife assembly 136.

The ground soft material which is discharged through orifices 134 in secondary orifice plate 132 mixes with the ground soft material discharged from the orifices formed in primary orifice plate 18, and thereby is incorporated into the final ground product.

As in the embodiment of FIG. 1, discharge auger 84 acts to move the collected hard material through the passage of discharge tube 130, for ultimate collection in a receptacle (not shown). A valve, such as 83 in FIG. 1, may be provided downstream of the discharge of discharge tube 130 for regulating the amount of pressure within discharge tube 130 and collection cavity 126. In this manner, an optimal operating condition can be attained so as to recover a maximum amount of soft material through secondary orifice plate 132 while removing substantially all hard material from the final ground product.

Figure 12:
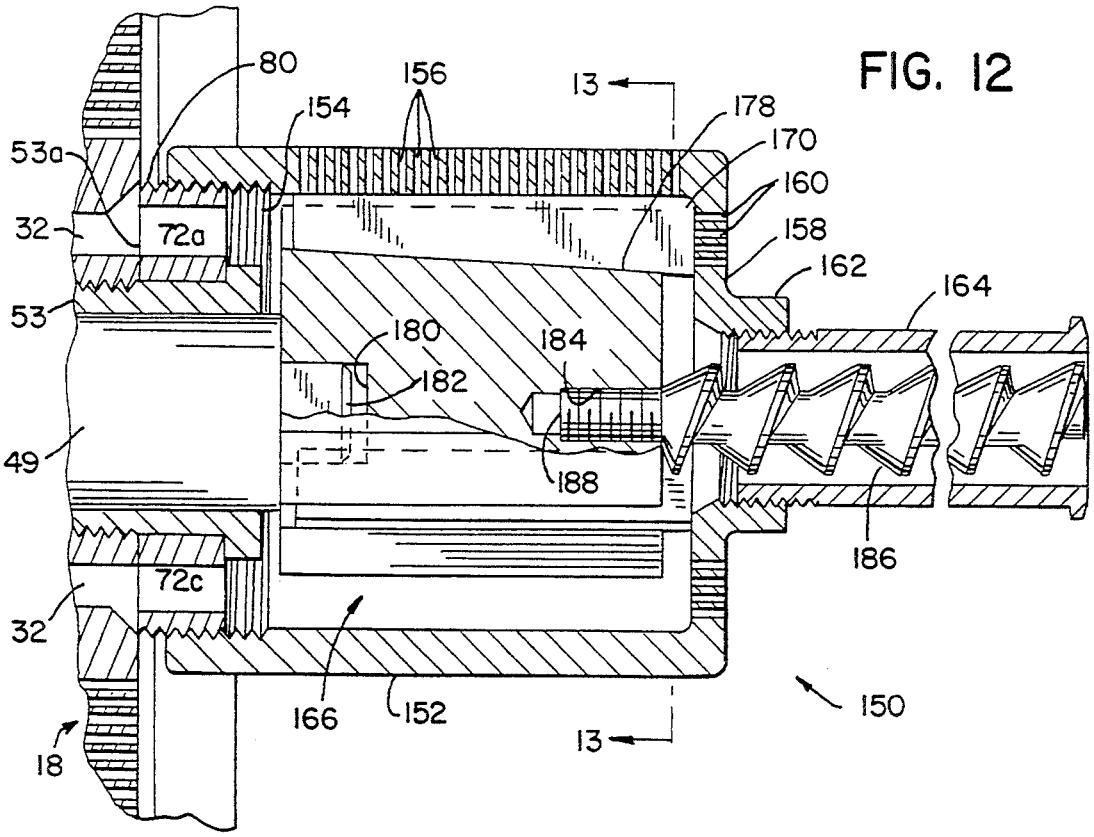
FIG. 12 is a view similar to FIG. 10, showing an alternative embodiment for providing recovery grinding of soft material.
Figure 13:
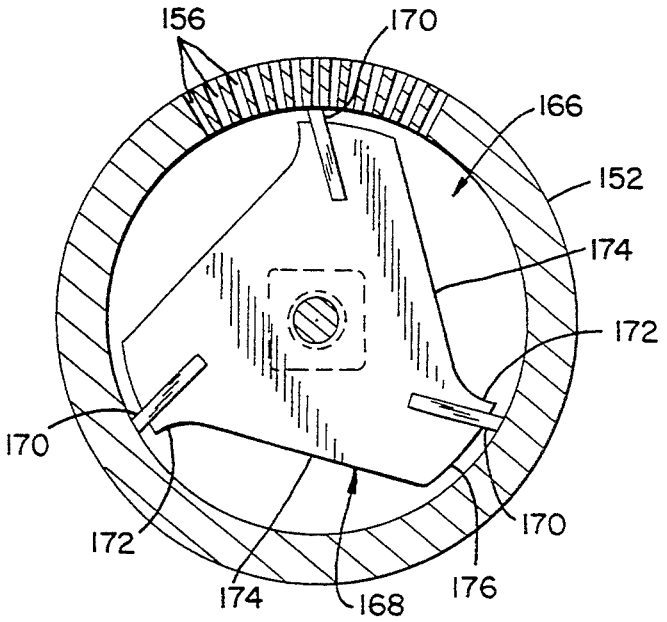
FIG. 13 is a sectional view taken generally along line 13—13 of FIG. 12.

FIG. 12 illustrates a recovery grinding arrangement 150. In this arrangement, a cylindrical housing 152 is provided with internal threads 154 which engage external threads 80 on adaptor plate 53*a*. Housing 152 is provided with a series of relatively small upwardly facing orifices 156 extending through the upper portion of its side wall. Orifices 156 are formed in the wall of housing 152 throughout an arc ranging between 60° and 120° . As shown in FIG. 13, the arc encompassing orifices 156 is approximately 60° . Housing 152 includes an end wall 158 which partially closes its end opposite the open end in which internal threads 154 are formed. An annular ring of relatively small orifices 160 is formed in end wall 158. An internally threaded nipple 162 is provided in end wall 158, and a discharge tube 164 having external threads at one of its ends is adapted for connection to nipple 162. With this arrangement, the internal discharge passage of discharge tube 164 is placed into communication with the interior of cylindrical housing 152.

A rotating recovery knife assembly 166 is disposed within the interior of housing 152. Knife assembly 166 includes a knife holding member 168 having three equally radially spaced axially extending lobes provided with outwardly facing slots in which knives 170 are mounted. Each lobe is formed by a substantially radial front surface 172 which merges into a leading surface 174 in a direction toward the preceding lobe. Each lobe further includes an outer surface 176 located inwardly of the inner wall of housing 152, and extending between the front surface 172 and the leading surface 174 of the succeeding lobe.

The slot formed in each lobe angles inwardly toward the center of knife holding member 168 in a direction toward end wall 158, such as illustrated by slot 178 in FIG. 12. Each knife 170 is provided with an inner surface having an angle adapted to mate with the angled inner surface of the slots, so as to maintain the outer edge of each knife 170 in contact with the inner surface of housing 152 throughout the length of knife 170. In addition, knives 170 have a height at their outer ends which extends throughout the thickness of the annular ring of orifices 160 formed in end wall 158. The end of knives 170 is in contact with the inner surface of end wall 158 throughout the width of the ring of orifices 160.

As in the FIG. 10 embodiment, spring 49*a* (FIG. 1) urges recovery knife assembly 166 against end wall 158 of housing 152.

Knife holding member 168 is provided at its inner end with a square recess 180 facing the outer end of centering shaft 49. Centering shaft 49 is provided with a square projection 182 which mates with the side walls of square recess 180, so as to impart rotation to knife holding member 168 in response to rotation of centering shaft 49 caused by rotation of feed screw 14.

The outer end of knife holding member 168 is provided with an internally threaded bore 184. A discharge auger 186 has an externally threaded stub shaft 188, which is engageable with threaded bore 184 to secure discharge auger 186 to knife holding member 168. With this arrangement, rotation of knife holding member 168 causes rotation of discharge auger 186, to advance hard material through the discharge passage of discharge tube 164.

In operation, the embodiment of FIG. 12 functions as follows. In a manner as described above, hard material is routed through collection openings 32 in orifice plate 18 to the discharge passages in adaptor plate 53*a*, such as shown at 72*a* and 72*c*, and into the interior of cylindrical housing 152. A certain amount of usable soft material is included with the hard material, and the soft material migrates outwardly toward the inner wall of housing 152, while the hard material migrates inwardly. The usable soft material is forced upwardly through orifices 156 in housing 152, and is severed by knives 170. In a similar manner, the soft material is forced outwardly through the ring of orifices 160 formed in end wall 158, and is severed by the ends of knives 170. The discharged soft material passing through orifices 156 and 160 is mixed with the ground soft material discharged from the upper portion of primary orifice plate 18, flowing downwardly along the sides of housing 152 into a hopper or the like. The hard material is routed along leading surfaces 174 of knife holding member 168 toward its outer end, and from there passes into the opening of nipple 162 and the discharge passage of discharge tube 164. Discharge auger 186 moves the hard material through discharge tube 164, thus creating a low pressure area at the entrance into nipple 162 to facilitate drawing the hard material thereinto.

In an alternate embodiment, the annular ring of small orifices 160 formed in end wall 158 can be eliminated, thus providing only radial upward flow of the recovered material through orifices 156 formed in housing 152.

FIGS. 14–16, 18 and 19 illustrate an alternative embodiment orifice plate 200, bushing assembly 202 and hard material collection and discharge assembly 204 for mounting to the downstream end of grinder housing 12 (FIG. 1), and like reference characters will be used where possible to facilitate clarity.

As with orifice plate 18, orifice plate 200 includes a large number of relatively small grinding openings (not shown) and a series of spaced collection openings or passages 206 extending between its upstream and downstream surfaces, which later will be explained in greater detail. Collection passages 206 are equally spaced from each other toward the inner portion of orifice plate 200 adjacent a central passage 208 formed in orifice plate 200. Alternatively, collection passages 206 may be spaced at unequal intervals. Bushing assembly 202 includes a bushing 210 which extends through passage 208, a cup-mounting adaptor 212, and a retaining ring 214.

Bushing 210 defines an axially extending passage 216 into which the end of centering shaft 48 extends. As in the embodiment of FIG. 1, discharge auger 84 is mounted to the end of centering shaft 48, and is rotatable along with centering shaft 48 in response to rotation of feed screw 14 for discharging collected hard material.

Bushing 210 includes an inner annular lip 218 which engages the upstream surface of orifice plate 200. Bushing 210 further includes an axially extending key 220 which protrudes radially outwardly from the outer surface of bushing 210. Key 220 is constructed to extend throughout a majority of the thickness of orifice plate 200, and to extend past the downstream surface of orifice plate 200. The outer surface of bushing 210 is provided with external threads 222 at its downstream end, forwardly of the downstream end of key 220.

Cup-mounting adaptor 212 is a disc-like member having a central passage 224 and external threads 226. A keyway 228 is formed in adaptor 212, extending radially outwardly from passage 224. Keyway 228 receives the downstream portion of bushing key 220, the upstream portion of which is received within a keyway 230 formed in orifice plate 200, extending radially outwardly from passage 208. Key 220 thus bridges between orifice plate 200 and adaptor 212 to align keyways 228, 230 with each other.

Figure 15:
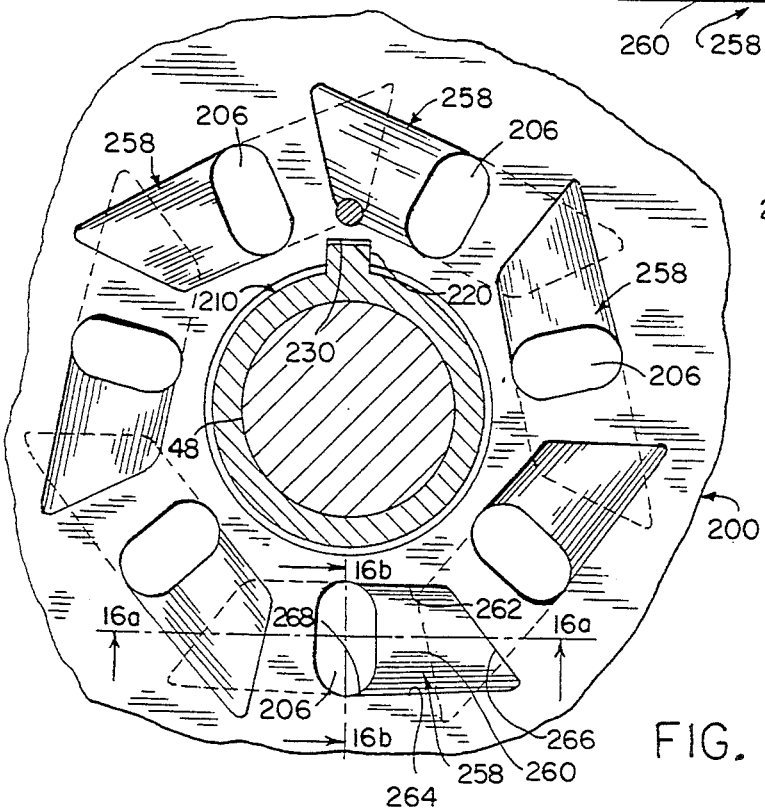
FIG. 15 is a partial section view taken along line 15—15 of FIG. 14.
Figure 18:
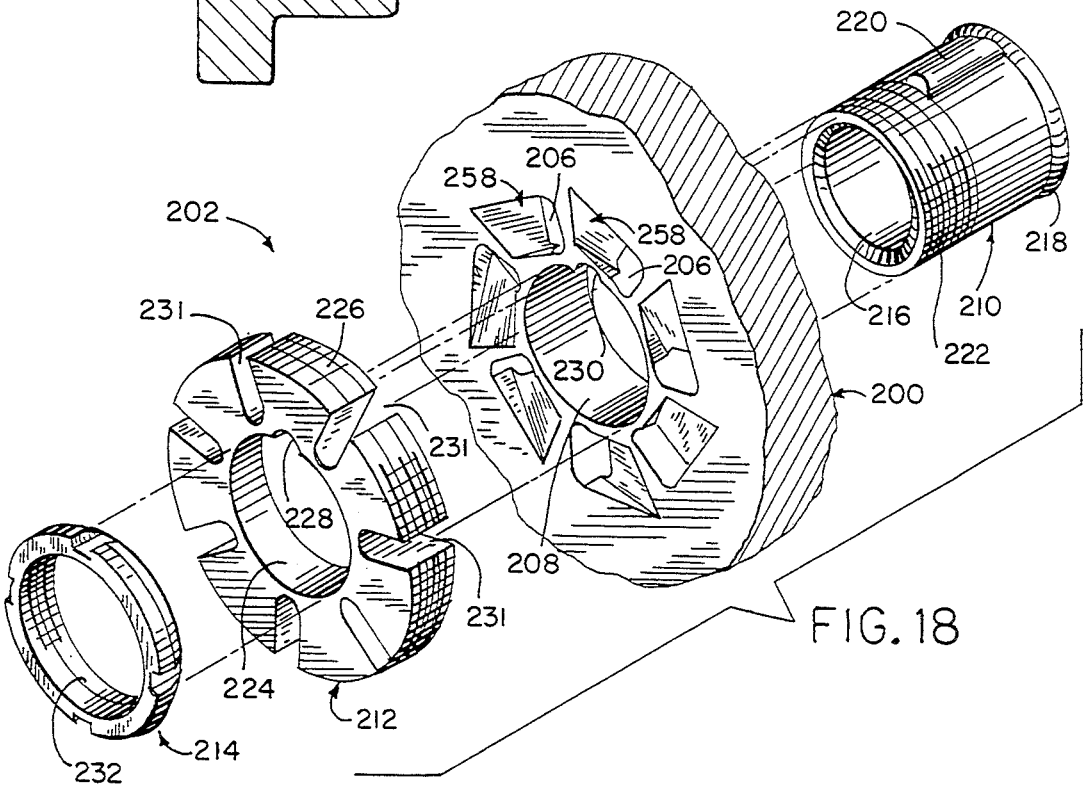
FIG. 18 is an exploded isometric view showing the central portion of the orifice plate, the shaft-mounting bushing and the collection cup adaptor.
Figure 19:
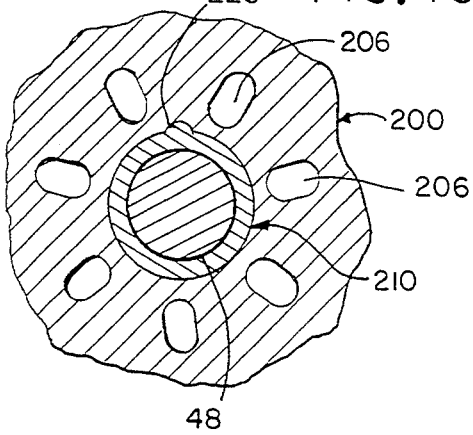
FIG. 19 is a partial section view taken along line 19—19 of FIG. 18.

Key 220 and keyway 230 may either be square as shown in FIG. 15, or rounded as shown in FIGS. 18 and 19.

Figure 14:
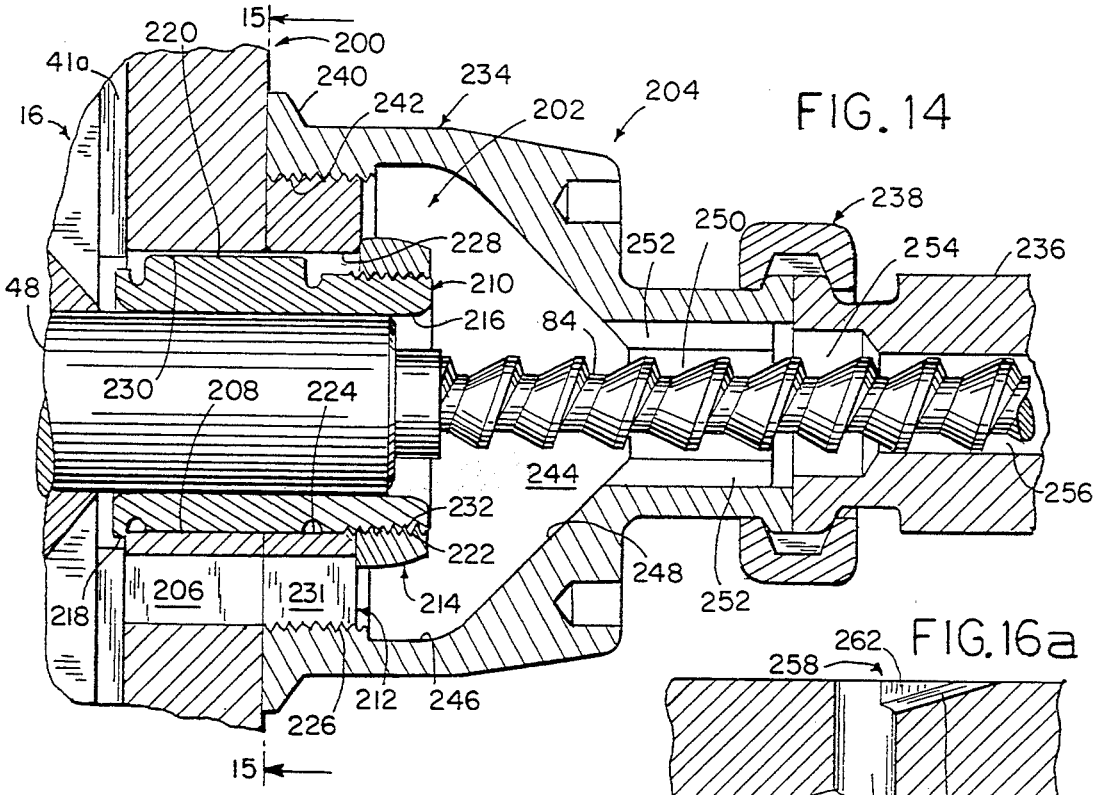
FIG. 14 is a sectional view similar to FIG. 1, showing another embodiment of the invention, specifically the manner in which the centering shaft bushing is interconnected with the orifice plate.

As shown in FIGS. 14 and 18, adaptor 212 includes a series of equally spaced radially extending slots 231 extending inwardly from the outer surface of adaptor 212 in which threads 226 are formed. The center-to-center spacing of slots 231 is equal to that of collection passages 206 formed in orifice plate 200.

Retaining ring 214 includes a set of internal threads 232 adapted to engage external threads 222 at the downstream end of bushing 210. Ring 214 has a diameter greater than the diameter of passage 224 formed in adaptor 212.

Bushing assembly 202 is mounted to orifice plate 200 as follows. First, bushing 210 is inserted in an upstream-to-downstream direction through passage 208 formed in orifice plate 200 until lip 218 engages the upstream surface of orifice plate 200, during which key 220 is received within orifice plate keyway 230. Adaptor 212 is then inserted in a downstream-to-upstream direction over the downstream portion of bushing 210, such that keys 20 is received within adaptor keyway 228. Ring 214 is then threadedly engaged with bushing threads 222 and moved to its FIG. 14 position in which it engages adaptor 212 to sandwich adaptor 212 between ring 214 and the downstream surface of orifice plate 200. With bushing lip 218 engaging the upstream surface of orifice 200, retaining ring 214 thus functions to securely mount bushing 210 and adaptor 212 to orifice plate 200.

The alignment of orifice plate keyway 230 with adaptor keyway 228 caused by key 220 bridging therebetween functions to align adaptor slots 231 with collection passages 206 formed in orifice plate 200.

Hard material collection and discharge assembly 204 generally consists of a collection cup 234 and a discharge conduit 236 interconnected with each other by means of a clamp member 238 or threaded adaptor (not shown). Collection cup 234 includes an upstream flange 240 and an internally threaded opening 242 engageable with external threads 226 of adaptor 212. With this arrangement, collection cup 234 is threadedly engaged with adaptor 212 after bushing assembly 202 has been assembled to orifice plate 200, such that the upstream surface of flange 240 engages the downstream surface of orifice plate 200. This functions to securely mount collection cup 234 to orifice plate 200.

Collection cup 234 includes a hard material collection cavity 244 defined by an upstream wall 246 and a tapered convergent wall 248 in an upstream-to-downstream direction. A discharge passage 250 extends downstream from collection cavity 244. A series of axial flutes 252 extend radially outwardly from passage 250 to provide axial movement of collected hard material through discharge passage 250. This feature is more fully set forth and described in application Ser. No. 07/778,010, filed Oct. 17, 1991, now U.S. Pat. No. 5,289,979 issued, Mar. 1, 1994, the disclosure of which is hereby incorporated by reference.

Conduit 236 includes an inlet recess 254 and a discharge passage 256. Discharge auger 84 extends through collection cavity 244, cup discharge passage 250 and inlet recess 254, and partially into and through conduit discharge passage 256. The-outermost-extent of the flighting of discharge auger 84 is in very close proximity to the internal wall of conduit 236 defining discharge passage 256, to essentially provide a rotating flow path for the discharge of hard material. This feature of the invention is also more fully set forth and explained in application Ser. No. 07/778,010, filed Oct. 17, 1991 now U.S. Pat. No. 5,28,979, issue Mar. 1, 1994.

In operation, the hard material collection and discharge assembly 204 of FIG. 14 functions as follows. As explained previously, hard material is supplied to collection passages 206 upon rotation of knife assembly 16. Such hard material passes from collection passages 206 through adaptor slots 231, and is discharged into collection cavity 244. Rotation of discharge auger 84 functions to move such collected hard material from collection cavity 244 into cup discharge passage 250, with flutes 252 functioning to provide axial movement of the hard material during rotation of discharge auger 84. The hard material then passes into inlet recess 254 of conduit 236, and into conduit discharge passage 256 for ultimate supply to a collection receptacle or the like.

FIGS. 15, 16 and 18 illustrate in detail the arrangement of collection passages 206, and reference is made to such figures for an explanation of the ramped entryway structure through which hard material enters collection passages 206.

A ramped entryway, shown generally at 258, is formed in the downstream and upstream surfaces of orifice plate 200 adjacent each collection passage 206. Each ramped entryway 258 extends tangentially relative to the center of orifice plate 200 and in a rotationally upstream direction from its associated collection passage 206 such that, upon rotation of knife assembly 16, each knife insert 41a first passes over the ramped entryway 258 prior to passing over collection passage 206.

Each ramped entryway 258 is defined by a bottom wall 260, an inner-side wall 262 and an outer side wall 264. As shown in FIG. **16*b* a radius is formed between each of side walls 262, 264 and bottom wall 260 in order to reduce stress concentrations in plate 200. Bottom wall 260 has a width approximately equal to the length of collection passage 206, which is oval in shape. Each collection passage 206 is oriented such that its major axis extends radially relative to the center of orifice plate 200. In the illustrated embodiment, seven equally spaced collection passages 206 are formed in orifice plate 200. It is understood, however, that any other satisfactory number and arrangement of collection passages 206** may be used in place of the specific number and arrangement as illustrated.

Figure 16A:
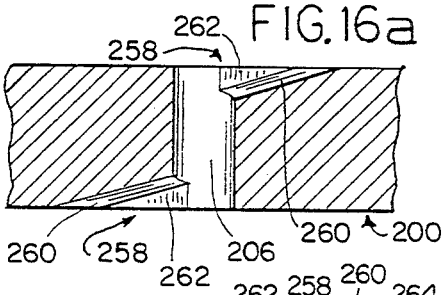
FIGS. 16*a* and 16*b* are partial section views taken along lines 16*a*—16*a* and 16*b*—16*b*, respectively, of FIG. 15.
Figure 16B:
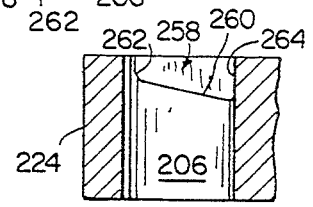

Each ramped entryway 258 extends between slot 206 and a line of intersection 266 with the surface of orifice plate 200. Bottom wall 260 is pitched in both an axial direction and in a radial direction, such that the greatest depth of bottom wall 260 is located adjacent the junction between bottom wall 260 and the outermost extent of collection passage 206, shown in FIG. 15 at 268. Referring to FIGS. 16*a* and 16*b*, ramped entryways 258 are pitched at an angle of approximately 16° in their axial direction, and at an angle of approximately 12° in a transverse direction.

In operation, ramped entryways 258 function to provide a smooth transition between the upstream surface of orifice plate 200 and collection passages 206 for facilitating routing of hard material to collection passages 206 upon rotation of knife assembly 16. Outer sidewall 264 of each ramped entryway 258 functions in cooperation with knife inserts 41*a* to shear chunks of hard material lodged therewithin during rotation of knife assembly 16. Similarly, the edges of collection passages 206 defining the intersection between collection passages 206 and the upstream surface of orifice plate 200 also function to shear chunks of hard material, to reduce the size of the hard material pieces and to allow them to pass into and through collection passages 206.

As in the previous embodiment, ramped entryways 258 are formed in both surfaces of orifice plate 200, to enable the operator to reverse the orientation of orifice plate 200 when one set of ramped entryways and collection passages has dulled.

Figure 17:
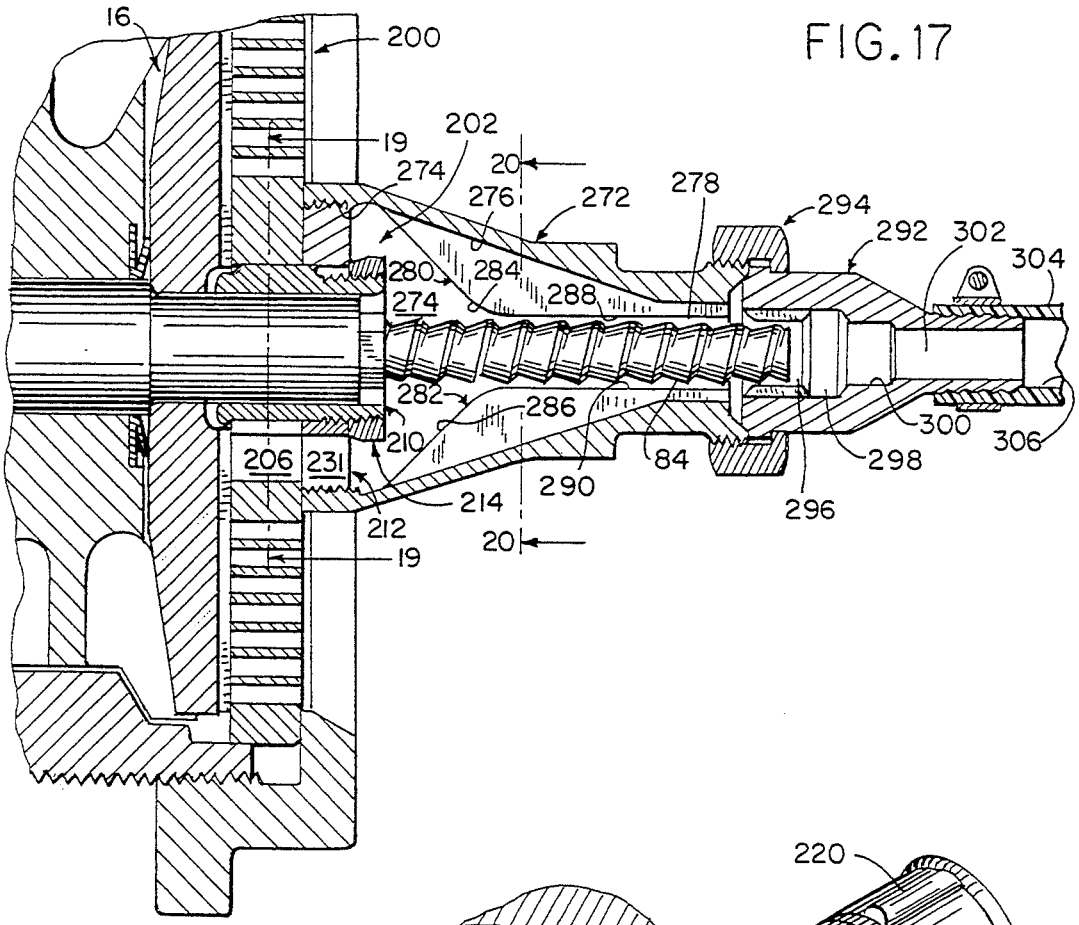
FIG. 17 is a sectional view similar to FIGS. 1 and 13, showing an alternate embodiment of the collection cup into which the hard material is discharged from the collection passages.

FIG. 17 illustrates bushing assembly 202 and orifice plate 200 as in FIG. 14, in which collection cup 234 is replaced with a hard material collection cone 272. Cone 272 includes an internally threaded opening 274 for engaging adaptor external threads 226, to mount cone 272 to adaptor 212 and retain cone 272 in position against the downstream surface of orifice plate 200.

Figure 20:
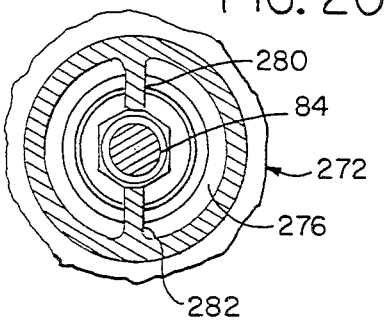
FIG. 20 is a partial section view taken along line 20—20 of FIG. 18.

Referring to FIGS. 17 and 20, collection cone 272 includes a tapered collection cavity 274 defined by a tapered convergent wall 276 in an upstream-to-downstream direction. A discharge passage 278 is located downstream of cavity 274. A pair of ribs 280, 282 are mounted to the inner surface of wall 276, extending into collection cavity 274. Ribs 280, 282 are spaced 180° apart from each other, and define angled upstream edges 284, 286, respectively and axially extending edges 288, 290, respectively located adjacent the flighting of discharge auger 84. Axial edges 288, 290 of ribs 280, 282, respectively, extend into and through discharge passage 278.

While only two ribs 280, 282 are shown and described, it is understood that any number of ribs such as 280, 282 could be mounted to wall 276 to facilitate optimal flow of hard material through collection cavity 274.

Downstream of collection cone 272, an adaptor 292 is mounted via a connector 294 to the downstream end of cone 272. Adaptor 292 includes a fluted inlet recess 296 which receives the downstream end of discharge auger 84, and an expansion chamber 298 communicating through a passage 300 with a discharge passage 302. A discharge conduit 304 defining a discharge passage 306 is mounted to the downstream end of adaptor 292.

In operation, as described previously, hard material is discharged into collection cavity 274 through orifice plate collection passages 206 and adaptor slots 231 upon rotation of knife assembly 16. Rotation of discharge auger 84 functions to move the hard material contained within collection cavity 274 in a downstream direction. Ribs 280, 282 function to prevent the collected hard material from simply spinning within cavity 274, ensuring that the collected hard material moves axially through collection cavity 274 into discharge passage 278. In a manner more fully explained in application Ser. No. 07/856,665, filed Mar. 24, 1992, now U.S. Pat. No. 5,344,086, issued Sep. 6, 1994, the disclosure of which is hereby incorporated by reference, the structure of the passages and chambers in adaptor 292 receives the hard material from discharge passage 278 and functions to supply such hard material to conduit discharge passage 306.

Figure 21:
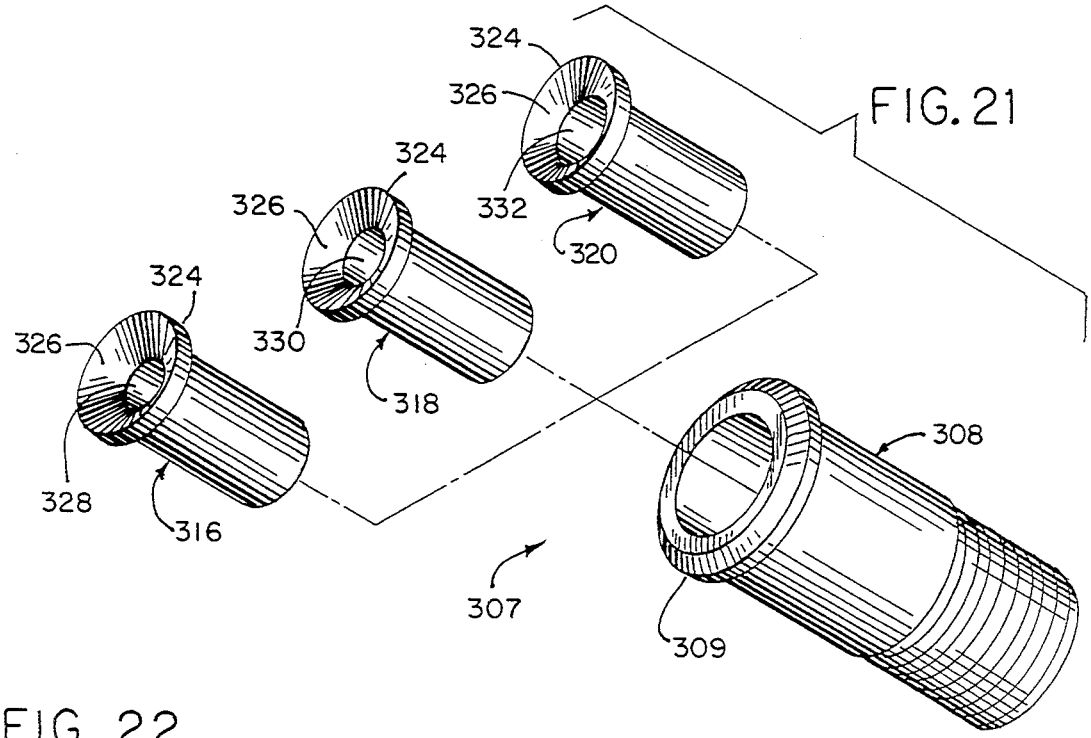
FIG. 21 is an isometric view showing a set of flow-restricting nozzle inserts for controlling the flow rate of hard material from the hard material collection system of the invention.
Figure 22:
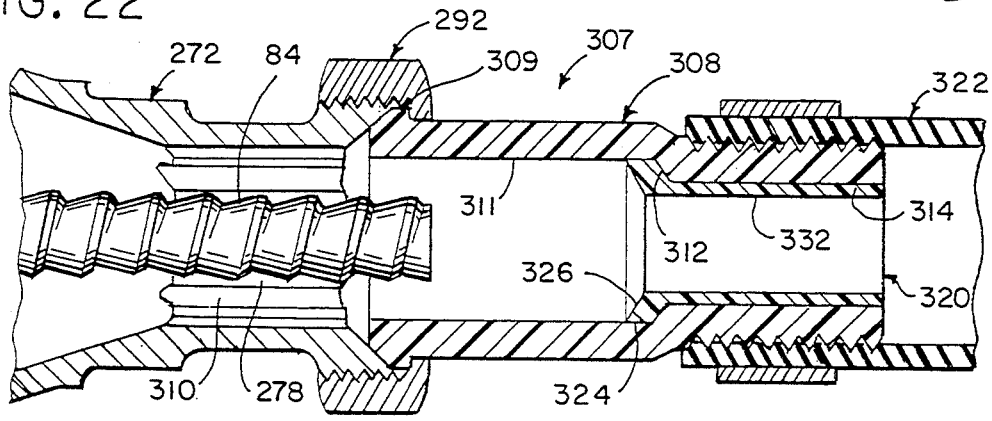
FIG. 22 is a partial section view showing the manner in which the flow-restricting nozzle inserts of FIG. 21 are mounted to the hard material collection system of the invention.

FIGS. 21 and 22 illustrate a flow-controlling assembly 307 adapted for mounting to the downstream end of cone 272 via connector 294 in place of adaptor 292. Flow-controlling assembly 307 generally includes a tube 308 having a flange 309 engaged by connector 294 for mounting tube 308 to cone 272. In the embodiment of FIG. 22, cone 272 includes a series of internal flutes 310 in place of ribs 280, 282, for providing axial flow of hard material through discharge passage 278 upon rotation of discharge auger 84.

Tube 308 defines an internal passage 311 which includes a shoulder 312 leading to a reduced-diameter passage 314. One of a series of nozzle inserts, shown in FIG. 21 at 316, 318 and 320, is placed into tube 308 to control the flow rate of hard material discharged from tube 308 into a discharge conduit 322, which is adapted to convey the discharged hard material to a collection receptacle or the like.

The forward portion of each of nozzle inserts 316–320 is identically constructed, with each of nozzle inserts 316–320 defining a flange 324 and an annular angled surface 326. The difference in nozzle inserts 316–320 is in the diameter of a passage extending longitudinally through the tubular body portion of each insert. Insert 316 defines a small diameter passage 328, insert 318 defines a medium diameter passage 330, and insert 320 defines a large diameter passage 332. FIG. 22 illustrates nozzle insert 320 in position within tube 308, providing a relatively low amount of restriction to flow of material through tube 308. Insert 316, on the other hand, provides the greatest amount of restriction to discharge of hard material from tube 308, and insert 318 provides a degree of restriction between that of nozzle inserts 316 and 320.

In operation, nozzle inserts 316–320 function to control the amount of hard material discharged from tube 308, thus controlling the amount of back pressure in collection cavity 274, which in turn controls the amount of hard material passing through orifice plate collection passages 206. This allows the operator to interchange inserts 316–320 according to the type of material being ground and the amount of hard material contained therein. For example, when grinding a relatively lower grade of meat having a large amount of hard material, the operator will install nozzle insert 320 to provide a small amount of restriction to discharge of hard material, to ensure that all hard material contained within the raw material is being collected and discharged into collection cavity 274. When grinding higher grade meat having a lesser amount of hard material, the operator will install either nozzle insert 316 or 318 to increase the back pressure in collection cavity 274 to prevent soft material from passing into collection cavity 274, which otherwise may occur if a lesser amount of back pressure existed in collection cavity 274. The size of the passages in the nozzle inserts can be customized according to specific operator requirements, if desired.

The interchangeable nozzle insert system illustrated in FIGS. 21 and 22 thus enables an operator to quickly and easily change the amount of material allowed to pass through the orifice plate and into the collection cavity, thus reducing the possibility of operator error while providing precise control of the hard material discharge flow rate.

While the invention as shown and described provides several features which enhance the ability of grinding head 10 to collect hard material during operation, it is understood that certain of the described features could be employed without other of the described features to yield improved hard material collection. For example, an orifice plate 18 constructed according to the invention could be employed with a prior art knife assembly, and would result in improved ability to collect hard material due to the advantages offered by ramped entryways 34 leading into collection openings 32. Knife assembly 16 as shown and described could be employed with a prior art orifice plate which does not include ramped entryways, and would result in improved hard material collection due to advantages in directing material inwardly offered by the construction of knife assembly 16. Recovery grinding arrangement 120 and 150 could be employed with a prior art grinding and hard material collection system, to provide recovery grinding of usable soft material which is collected along with the hard material. To most effectively collect hard material and recover usable material, however, the features as described are combined into a single structure.

The advantages offered by the invention in collecting hard material and recovering collected soft material allows an operator to use a lower grade of meat to be ground which typically includes a greater amount of hard material than does a higher grade of meat. Accordingly, the operator can reduce the cost of producing ground meat by employing a lower grade of material, while yielding a final ground meat product which is comparable in quality to that attained with use of a higher grade raw material in a prior art system.

The adjustability feature described previously, in which the clearance provided between the inner surface of orifice plate 18 and the end 58 of the pressure flighting, allows the operator to adjust grinding head 10 according to the hard material conditions in the meat being ground. For a lower grade of meat, which may contain large pieces of hard material, the clearance between the inner surface of orifice plate 18 and pressure flighting end 54 is increased. This allows the large pieces of material to ride on the inner surface of orifice plate 18 without being repeatedly subjected to pressure exerted by pressure flighting end 54, which otherwise may cause the piece of material to chip against grinding orifices 30. In this manner, the large piece of material is directed inwardly toward collection orifices 32 without being repeatedly subjected to exertion of pressure, and is reduced in size as described previously for ultimate passage through collection openings 32. When a higher grade of meat is being ground, and which contains smaller pieces of hard material, the clearance between the inner surface of orifice plate 18 and pressure flighting end 54 is decreased. In all situations, however, knife assembly 16 is urged against the inner surface of orifice plate 18 by spring washer assembly 46.

Various alternatives and embodiments are contemplated as being within the scope of the following claims, particularly pointing out and distinctly claiming the subject matter regarded as the invention.

I claim:

1. In a grinder for grinding material, comprising a housing having an outlet; a primary auger mounted within the housing for advancing material through the housing; a shaft extending from the primary auger and rotatable therewith; and an orifice plate mounted at the housing outlet; the improvement comprising:

an opening formed in the orifice plate;

a bushing mounted within the orifice plate opening, the bushing having a passage for receiving the shaft;

wherein the orifice plate opening and the bushing include mating key-and-keyway structure for preventing rotation of the bushing relative to the orifice plate;

a housing defining a hard material collection cavity located downstream of the orifice plate;

an adaptor mounted to the orifice plate for interconnecting the housing with the orifice plate, wherein the bushing extends through the adaptor; and key-and-keyway structure interposed between the adaptor and the bushing for preventing rotation therebetween.

2. The improvement of claim 1, wherein the bushing includes a lip engageable with the upstream surface of the orifice plate, and further includes threads extending outwardly of the adaptor, and further comprising a retaining ring engageable with the bushing threads and with the adaptor, wherein threaded engagement of the retaining ring with the threads results in engagement of the retaining ring with the adaptor to sandwich the adaptor between the retaining ring and the downstream surface of the orifice plate.

3. The improvement of claim 1, wherein the orifice plate includes a series of spaced collection passages for receiving hard material from the upstream surface of the orifice plate, and wherein the adaptor includes a series of radially spaced slots in alignment with the collection passages, wherein the key-and-keyway structure interposed between the adaptor and the bushing functions to ensure alignment of the slots with the collection passages.

4. The improvement of claim 3, wherein the bushing includes a single key engageable with a keyway formed in the orifice plate and a keyway formed in the adaptor for providing alignment of the adaptor slots with the collection passages.

5. An orifice plate, comprising:

a series of relatively small outer grinding orifices extending through the plate; and a series of spaced collection passages located toward the center of the orifice plate, each collection passage having a ramped entryway opening onto a surface of the orifice plate and leading directly into the collection passage, wherein each ramped entryway extends along an axis oriented tangentially relative to the center of the orifice plate;

wherein the collection passages each extend along a longitudinal axis, and wherein each ramped entryway extends substantially perpendicularly to the longitudinal axis of its associated collection passage.

6. The orifice plate of claim 5, wherein the longitudinal axis of each collection passage is oriented radially relative to the center of the orifice plate.

7. An orifice plate, comprising:

a series of relatively small outer grinding orifices extending through the plate; and a series of spaced collection passages located toward the center of the orifice plate, each collection passage having a ramped entryway opening onto a surface of the orifice plate and leading directly into the collection passage, wherein each ramped entryway extends along an axis oriented tangentially relative to the center of the orifice plate, and wherein each ramped entryway is defined by a pitched bottom wall extending between a pair of sidewalls oriented substantially perpendicular to the surface of the orifice plate.

8. The orifice plate of claim 7, wherein the bottom wall is pitched so as to provide its location of greatest depth at the intersection of the bottom wall with the outermost extent of the collection passage.

9. In a grinder for grinding material, comprising a housing having an outlet; a primary auger mounted within the housing for advancing material through the housing toward the outlet; a shaft extending from the primary auger and rotatable therewith; and an orifice plate mounted at the housing outlet, the improvement comprising:

a series of spaced collection passages formed in the orifice plate for receiving hard material;

a collection housing located downstream of the orifice plate and defining an internal collection cavity;

a bushing interconnected with the orifice plate including a central passage for receiving the shaft; and an adaptor mounted to the bushing, wherein the housing is mounted to the adaptor for securing the housing in position adjacent the downstream surface of the orifice plate.

10. The improvement of claim 9, wherein the adaptor is non-rotatably mounted to the bushing and is removably secured thereto by means of a retaining ring engageable with the bushing and with the adaptor, and wherein the adaptor and housing define mating thread structure for removably mounting the housing to the adaptor.

* * * * *